US005639591A

United States Patent [19]

Adachi

[11] Patent Number: 5,639,591

[45] Date of Patent: Jun. 17, 1997

[54] SILVER HALIDE PHOTOGRAPHIC LIGHT-SENSITIVE MATERIAL

[75] Inventor: Hitoshi Adachi, Hino, Japan

[73] Assignee: Konica Corporation, Japan

[21] Appl. No.: 369,907

[22] Filed: Jan. 9, 1995

[30] Foreign Application Priority Data

Jan. 14, 1994 [JP] Japan ..... 6-002730

[51] Int. Cl.[6] ..... G03C 1/035; G03C 5/16

[52] U.S. Cl. ..... 430/567; 430/570; 430/966

[58] Field of Search ..... 430/966, 567, 430/570

[56] References Cited

U.S. PATENT DOCUMENTS

| | | | |
|---|---|---|---|
| 3,923,515 | 12/1975 | van Stappen | 430/966 |
| 4,425,425 | 1/1984 | Abbott et al. | 430/502 |
| 4,425,426 | 1/1984 | Abbott et al. | 430/966 |
| 4,683,193 | 7/1987 | Ihama et al. | 430/570 |
| 5,436,122 | 7/1995 | Shigetomi | 430/567 |
| 5,466,566 | 11/1995 | Tashiro et al. | 430/505 |
| 5,514,529 | 5/1996 | Mihayashi et al. | 430/544 |
| 5,561,038 | 10/1996 | Goan | 430/567 |

FOREIGN PATENT DOCUMENTS 634690 1/1995 European Pat. Off. .

*Primary Examiner*—Mark F. Huff

*Attorney, Agent, or Firm*—Jordan B. Bierman; Bierman, Muserlian and Lucas LLP

[57] ABSTRACT

A silver halide black and white photographic light-sensitive material is disclosed, comprising a support having thereon two silver halide emulsion layers, wherein a silver halide emulsion layer provided further from the support contains tabular silver halide grains having an aspect ratio of not less than 3, another silver halide emulsion layer containing silver halide grains having an aspect ratio of not more than 2.5; both silver halide grain emulsions are each spectrally sensitized by adding thereto a spectral-sensitizing dye in the form of a dispersion of solid particles dispersed in an aqueous medium.

8 Claims, 1 Drawing Sheet

SILVER HALIDE PHOTOGRAPHIC LIGHT-SENSITIVE MATERIAL

FIELD OF THE INVENTION

The present invention relates to a silver halide photographic light-sensitive material, and more particularly to a silver halide black and white photographic light-sensitive material which has high sensitivity and high sharpness and is stable in sensitivity.

BACKGROUND OF THE INVENTION

In the field of radiographic photographic light-sensitive material for medical use, rapid processing is demanded due to the increase of the number of radiographs caused by the increase in frequency of diagnoses and increase in radiographing items necessary for sure diagnoses and due to the necessity for showing the results of diagnoses promptly. Especially, in the field where processing in a short time is required such as arteriography and radiographing during surgical operation, rapid processing is essential.

Accordingly, in order to satisfy the above-mentioned requirements, it is necessary to promote automation and enhancing speed of radiographing and processing operation. An X-ray film used is also necessary to be provided with performance corresponding to rapid processing. However, in the case of rapid processing, deterioration in image quality is caused because the film is frequently processed with high pH and high temperature (30° to 40° C.).

For the demand for rapid processing not causing deterioration in image quality, recently, a tabular silver halide grains are used. Since the specific surface area of tabular silver halide grains is large, sensitizing dye can be adsorbed in a large amount so that spectral sensitivity can be enhanced. In addition, cross-over light is decreased and light scattering are small so that images with high resolution can be obtained.

The use of these tabular grains was expected to lead a silver halide photographic light-sensitive material with high sensitivity and high image quality. However, according to the study of the present inventors, the following facts were found. A spectral sensitizing dye dissolved with methanol for addition is easily desorbed to from a silver halide grain so that it moves over coating layers after being coated. Especially, when these photographic light-sensitive material is stored at high temperature and high humidity, fogging and reduction in sensitivity (desensitization) are liable to occur. Therefore, it does not provide a merit of using tabular silver halide grains.

In addition, in the case of a film having emulsion layers on both sides of a support, the so-called cross-over exposure phenomenon wherein a light emitting from a intensifying screen on one side passes through an adjoining emulsion layer and is dispersed by a support, giving image-wise exposure to the emulsion layer on the opposite side is caused so that sharpness of image is deteriorated.

Especially, an X-ray photography for medical use is provided with a fluorescent screen having an emitting material which serves as a light-source on both side sandwiching a film having emulsion layers provided on both sides of a support, and an X-ray image is formed by light emitted from the emitting material. Therefore, whether or not there is an influence from cross-over light from the other side greatly affects the level of image quality.

In order to inhibit cross-over exposure and improve sharpness, many proposals have been made so far. For example, Japanese Patent O.P.I. Publication No. 132945/1986 and British Patent No. 821,352 disclose films wherein a dye is incorporated in a silver halide emulsion layer or a structuring layer.

For example, there is a method to limit the entering of the cross-over light to the photographic light-sensitive layer by providing a hydrophilic colloidal layer containing a dye which is chemically inactive, giving no influence on a photographic emulsion and which is easily decolored or dissolved out during processing steps such as development and fixing, giving no trace of coloration on the photographic light-sensitive material after being processed.

However, the use of a soluble dye, resulted in diffusion of the dye from the cross-over-cutting layer to an adjacent layer. Therefore, many problems such as sensitivity reduction occur. In order to prevent the diffusion of dye, polymer mordants such as mordant has been used as a fixing technique of the soluble dye. However, stain due to the residual dye tends to occur.

Especially, in the case of the recent super rapid processing with the total processing time of 60 seconds or less, the dye causes stain on the light-sensitive material after being processed.

SUMMARY OF THE INVENTION

Accordingly, an object of the present invention is to provide a silver halide photographic light-sensitive material having high sensitivity, without deterioration thereof with aging, and high sharpness.

The objects of the present invention were attained by (1) a silver halide light-sensitive photographic material comprising a support having at least two silver halide emulsion layers provided on one side of the support, wherein a silver halide emulsion layer, which is provided farther from the support than the other silver halide emulsion layer, contains a tabular silver halide grain having an aspect ratio of not less than 3 and (b) the other silver halide emulsion layer provider closer to the support contains a silver halide grain having an aspect ratio of not more than 2.5; and (2) the silver halide photographic light-sensitive material described in (1), wherein said silver halide grain emulsions are spectrally sensitized with a spectral sensitizing dye prepared in a manner so as to be dispersed in the form of solid particles.

BRIEF EXPLANATION OF THE INVENTION

FIG. 1(*a*) is a schematic view of a high speed stirrer type dispersion machine and FIG. 1(*b*) shows a perspective view of an impeller.

1. tank, 2. dissolver, 3. vertical shaft, 4. solution, 5. impeller, 6. and 7. blade.

DETAILED DESCRIPTION OF THE INVENTION

Figure 1:
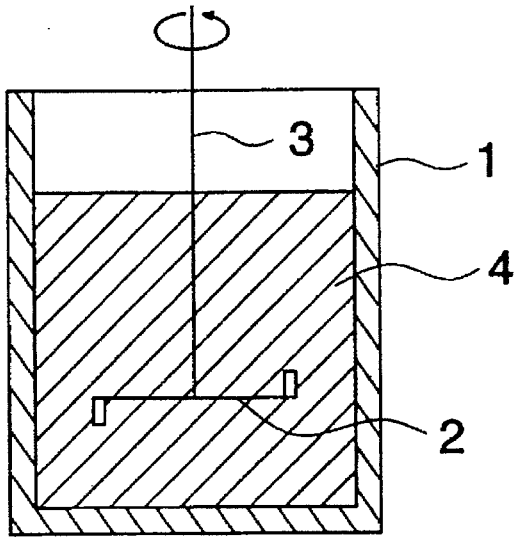
Figure 1:
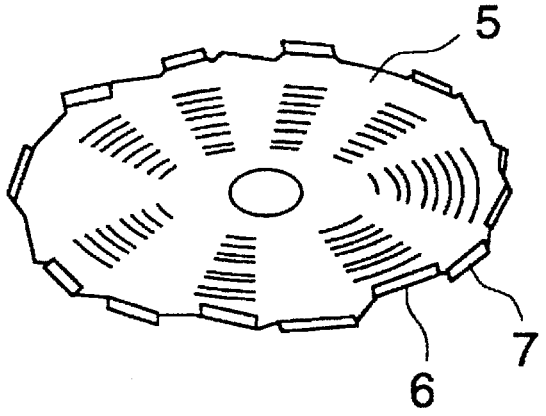

The component layers of the silver halide photographic light-sensitive material of the present invention include a subbing layer provided on a support, a silver halide emulsion layer (second emulsion layer), an other emulsion layer (first emulsion layer) and a surface protective layer, wherein the first layer is provided farther to the support than the second layer.

There is no limitation to the above-mentioned subbing layer and surface protective layer. For example, each additives described in Research Disclosure (RD) No. 17643, (RD) 18716 (November, 1979) and (RD) 308119 (December, 1989) can be used. With regard to a coating method onto the support, the above-mentioned research disclosures can be referred to.

In the invention, the first silver halide emulsion layer comprises silver halide twin crystal grains having an aspect ratio (grain diameter/grain thickness) of 3.0 or more, preferably, 3.0 to 8.0, and accounting for not less than 50% of the projected area of total grains contained in the layer. The second silver halide emulsion layer, which is closer to the support than the first emulsion layer, comprises silver halide grains having an aspect ratio of 2.5 or less, preferably, 1.0 to 2.0, and accounting for not less than 50% of the projected area of total grains contained in the layer. The grains contained in the second emulsion layer are preferably monodispersed regular crystal grains.

A grain diameter in the present invention is defined to be a diameter of a circular image having the same area as the projected image of the grain. The thickness of the grain is defined to be the distance between two major faces of the grain which are substantially parallel crystal faces. The projected area of a grain can be calculated from the sum of grain area.

The projected area can be obtained by photographing the samples of silver halide crystals distributed on the stand to a degree not causing the superposing of grains with an electron microscope of 10,000 to 50,000 times magnification and actually measuring the grain diameter or the projected area on the photograph. The number of grains measured is preferably 1000 pcs or more selected at random.

The thickness of the grain can be calculated by observing the sample obliquely by means of an electron microscope.

Mono-dispersed emulsion of the present invention is one having a width of dispersion defined by $$\text{(Standard deviation of grain size)}/\text{(Average grain size)}\times 100=\text{(width of dispersion) (\%)}$$

that is 30% or less and preferably 20% or less. Here, the measurement method of grain size is in accordance with the above-mentioned measurement method. The average grain size is a simple average.

$$\text{(Average grain size)}=\Sigma dini/\Sigma ni$$

In order to prepare a mono-dispersed emulsion, a water-soluble silver salt solution and a water-soluble halide solution are incorporated into a gelatin solution containing a seed grain by means of a double jet method under controlling pAg and pH. For controlling addition rate, Japanese Patent O.P.I. Publication Nos. 48521/1979 and 49938/1983 can be referred.

A twinned grain of the present invention means a silver halide crystal having one or more twinned plane inside the grain. Classification of the type of twinned-crystal is described in detail in Photographisch Korrespondenz Volume 9, page 57 reported by Klein and Moisar. Two or more twin planes of the twinned crystal may either be in parallel or not in parallel. The twin plane can be observed by an electron microscope directly. The silver halide may be dispersed in a resin for solidifying so that the twinned crystal can be observed from cross section in a form of a super-thin cut sample.

The silver halide twinned grains contained in the silver halide emulsion of the present invention is mainly comprised of grains having two or more parallel twinned plane, and preferably ones having even number of twin planes and more preferably having two twin planes.

Here, the expression, mainly comprised of grains having two or more parallel twinned planes means that twinned crystal grains having 2 or more parallel twinned planes account for 50% or more, preferably 60% or more and preferably 70% or more in terms of the number when crystals are counted from larger grains.

A mono-dispersed twinned crystal of the present invention is a twinned crystal wherein the width of distribution of twinned grains is 30% or less and preferably 20% or less.

In the present invention, silver halide grains having an aspect ratio of 2.5 or less include regular-formed crystals such as cubic, octahedral and tetradecahedral crystal grains.

The composition of silver halide of the silver halide emulsion used for the present invention is either of silver iodobromide or silver chloroiodobromide containing silver iodide of 2.0 mol % or less, preferably, 2.0 to 0.05 mol % more preferably.

With regard to the distribution of halide within the grain, either a uniform structure or a layered structure (core/shell structure) is allowed.

The silver halide emulsion usable for the present invention may be formed by means of either of an acidic precipitation method, a neutral precipitation method or an ammoniacal precipitation method. As a method to react a soluble silver salt and a soluble halide salt, a double jet method (a simultaneous mixing method) is used. As a simultaneous mixing method, a controlled double-jet method, can also be used, in which the pAg of a liquid phase is kept at a given value. According to this method, silver halide emulsion grains having a crystal form is regular and grain size is close to uniform can be obtained.

For the silver halide emulsion usable in the present invention, various hydrophilic colloidal materials can be used as a binder. As such a hydrophilic colloid, there may be used synthetic polymers such gelatin, polyvinyl alcohol and polyacrylic amide, and photographic binders such as a colloidal albumin and polysuccalose derivatives.

As technology to disperse a spectral sensitizing dye in the form of solid fine particles of the present invention, a method described in Japanese Patent O.P.I. Publication No. 288842/1989 is known. According to this method, an organic dye is made non-diffusible in the silver halide photographic light-sensitive material, therefore, it is merely a mechanical dispersion method. To the contrary, the object of the present invention is to adsorb a spectral sensitizing dye for photographic use on the surface of silver halide particles uniformly and effectively. The present invention is distinct from the above-mentioned technologies which is merely a dispersion-addition technique. In the present invention, residual color stain is small and diffusibility of the dye to the other layers is small. In addition, since there is no development hindrance, the dye can be used in a large amount.

An organic solvent means a solvent containing carbon atoms which is liquid at room temperature. Conventionally, a water-mixable organic solvent has been used as a solvent for a sensitizing dye.

For example, alcohols, ketones, nitriles and alkoxy alcohols have been used. Practically, methyl alcohol, ethyl alcohol, n-propyl alcohol, isopropyl alcohol, ethylene glycol, propylene glycol, 1,3-propane diol, acetone, acetonitrile, 2-methoxyethylalcohol and 2-ethoxyethyl alcohol are used.

In the present invention, these organic solvents, preferably, are not contained.

In addition, as a surfactant, an anion type surfactant, a cation type surfactant, a nonion type surfactant and a betain type surfactant have been used.

Conventionally, these surfactants have been used as a dispersing agent for a sensitizing dye. The present invention, preferably, does not contain these surfactants.

A spectral sensitizing dye in the present invention is referred to be ones which is adsorbed on silver halide and cause to transfer an electron to silver halide when it is subjected to photoexcitation. Organic dyes are not included.

A spectral sensitizing dye used in the invention is that which undegoes electron transfer toward silver halide and resultingly contributes to the sensitization of silver halide when photo-excited in a state of being adsorbed on silver halide grains, therefore, a organic dye is not included in the invention. Spectral sensitizing dyes of the invention may have any chemical structure as long as their solubility in water is in a range of $2\times10^{-4}$ to $4\times10^{-2}$ mol/liter and are preferably cyanine dyes. The cyanine dye may have the following formula (D).

formula (D)

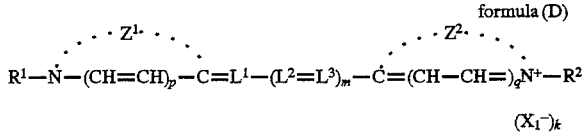

wherein $Z^1$ and $Z^2$ independently represent an nonmetallic atom group necessary for forming a 5- or 6-membered ring; $R^1$ and $R^2$ are independently a substituted or unsubstituted alkyl group; $L^1$, $L^2$ and $L^3$ are independently a substituted or unsubstituted methine group; p and q is 0 or 1; m is 0, 1, 2 or 3; X represents an anion; and k is 0 or 1.

More preferably, the cyanine dye is one having a hydrophilic group such as —$SO_3H$ or —COOH.

Examples are given below, wherein the solubility thereof in water is also shown in terms of mol per liter of water at 27° C.

D-1

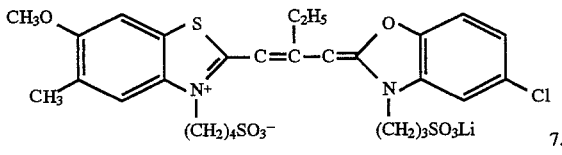

$7.6\times10^{-3}$ (mol/1)

D-2

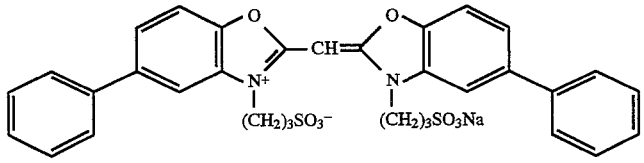

$2.8\times10^{-4}$ (mol/1)

D-3

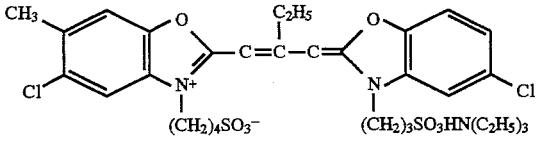

$7.4\times10^{-3}$ (mol/1)

D-4

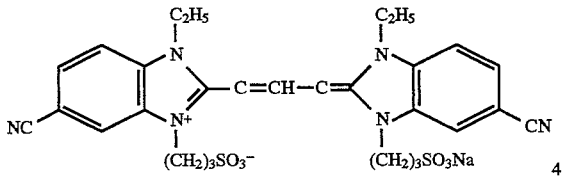

$4\times10^{-3}$ (mol/1)

D-5

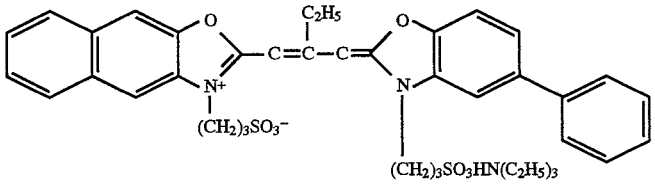

$5\times10^{-4}$ (mol/1)

-continued

D-6

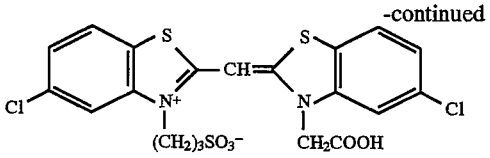

$6 \times 10^{-3}$ (mol/1)

D-7

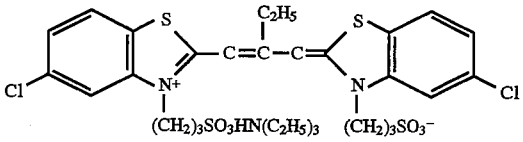

$2.3 \times 10^{-3}$ (mol/1)

D-8

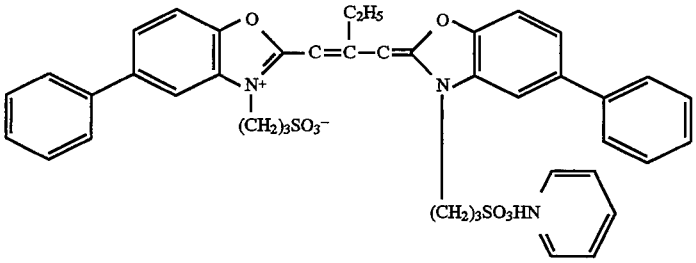

$2.6 \times 10^{-4}$ (mol/1)

D-9

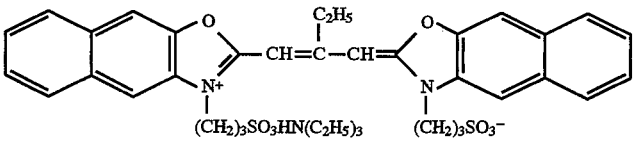

$5.9 \times 10^{-4}$ (mol/1)

D-10

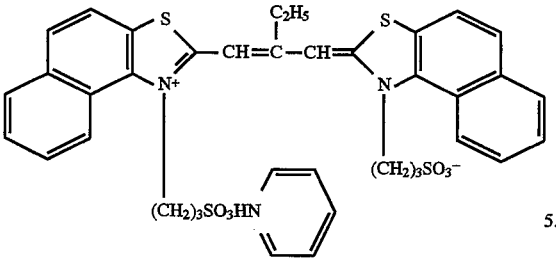

$5.9 \times 10^{-4}$ (mol/1)

D-11

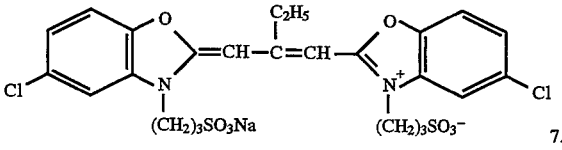

$7.8 \times 10^{-3}$ (mol/1)

D-12

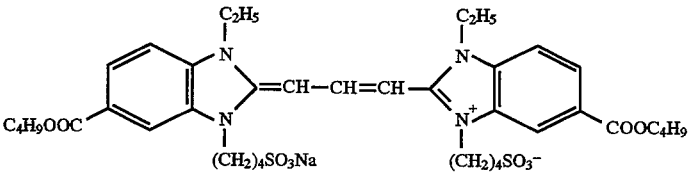

$5.5 \times 10^{-3}$ (mol/1)

The amount of the dyes to be added is preferably from $2\times10^{-7}$ to $1\times10^{-2}$ mol and more preferably from $2\times10^{-7}$ to $5\times10^{-3}$ mol per mol of silver halide.

As a method to disperse a spectral sensitizing dye in water substantially containing no organic solvent, various dispersion methods are used. Practically, a high speed stirrer, a ball mill, a sand mill, a colloid mill, an attriter and a supersonic dispersing machine can be used. In the present invention, a high speed stirrer is preferable.

As a high speed stirrer, as shown in FIG. 1(*a*), there is exemplified one composed of tank 1, dissolver 2 and vertical rotary shaft 3 is exemplified. FIG. 1(*b*) shows a dissolver.

The high speed stirrer dispersing machine may be one which is equipped with a dissolver provided with plural impellers on a vertical shaft or a multi-shaft dissolver provided with plural vertical shafts.

In addition, as a dissolver, a high speed stirrer type dispersion machine with no accessory or having an anquor wing is more preferable.

An example of practical operation is as follows. Water is poured in a tank whose temperature is capable of being controlled. A given amount of powder of spectral sensitizing dye is poured therein so that it is stirred over a period of time while the temperature is controlled. Thus, the powder is crushed and dispersed. There is no limitation as to pH or temperature when the spectral sensitizing dye is aerated for dispersion. However, at low temperature, dispersion for a long time cannot reach desired particle size. At high temperature, coagulation or decomposition occur so that no desired photographic performance cannot be achieved. In addition, when temperature is raised, the viscosity of dissolution system is lowered so that crushing of solid and dispersion efficiency is remarkably lowered. Therefore, it is preferable that the dispersion temperature is ranged from 15° to 50° C.

With regard to the speed of stirring rotation, it takes a long hours for obtaining desired particle size at low speed of rotation. When the number of rotation is too high, air bubble is involved so that dispersion efficiency is lowered. Therefore, it is preferable to disperse at 1000 to 6000 rpm.

surfactant, a nonionic surfactant or an amphoteric surfactant. However, it is preferable not to use a surfactant.

A silver halide emulsion used in of the present invention may be desalted to remove soluble salt so as to be suitable for chemical ripening by an appropriate method after the end of the growth of silver halide particles. There can be used methods described in Research Disclosure No. 17643 (RD. 17643, December, 1978) such as a coagulation method and a noodle washing method. The preferable washing method includes one using an aromatic hydrocarbon aldehyde resin as described in Japanese Patent Publication No. 16086/1970 and a desalting method using polymer coagulating agents G-3 and G-8 as described in Japanese Patent O.P.I. Publication No. 7037/1990 are cited.

To the photographic light-sensitive material using the silver halide emulsion of the present invention, each photographic additive can be used before or after a physical ripening step and a chemical ripening step. As a compound used in such steps, compounds described in the above-mentioned Research Disclosure RD17643, RD18716 (November, 1979) and RD308119 (December, 1989) are cited. Kinds of compounds described in these Research Disclosures and sections described therein are as follows:

| | RD17643 | | RD18716 | | RD308119 | |
|---|---|---|---|---|---|---|
| Additive | Page | Clasification | Page | Clasification | Page | Clasification |
| Chemical sensi-tizer | 23 | III | 648 at upper right portion | | 996 | III |
| Sensi-tizing dye | 23 | IV | 648 to 649 | | 996 to 998 | IVA |
| Desensi-tizing dye | 23 | IV | | | 998 | IVB |
| Dye | 25 to 26 | VIII | 649 to 650 | | 1003 | VIII |
| Develop-ment acceler-ator | 29 | XXI | 648 upper right | | | |
| Anti-foggant and stabili-zer | 24 | IV | 649 upper right | | 1006 to 1007 | VI |
| White-ning agent | 24 | V | | | 998 | V |
| Surfac-tant | 26 to 27 | XI | 650 right | | 1005 to 1006 | XI |
| Anti-static agent | 26 to 27 | XI | 650 right | | 1006 to 1007 | |
| Plasti-cizer | 27 | XII | 650 right | | 1006 | XII |
| Lubri-cant | 27 | XII | 650 right | | 1006 | XII |
| Matting agent | 28 | XVI | 650 right | | 1008 to 1009 | XVI |
| Binder | 26 | XXII | | | 1009 to 1014 | XXII |
| Support | 28 | XVII | | | 1009 | XVII |

A dispersion of the present invention is a suspension of a spectral sensitizing dye, and preferably the weight ratio of the spectral sensitizing dye in the suspended solution is 0.2 to 5.0%.

The dispersion of a spectral sensitizing dye in the present invention may be added to the silver halide emulsion directly or added to it after being diluted appropriately. For the diluting solution, water is used.

As a method to add the spectral sensitizing dye to the silver halide emulsion by dye in the form of solid fine particle dispersed in an aqueous medium, various methods can be used.

In the present invention, a water-insoluble dispersion of a sensitizing dye dispersed in water substantially not containing an organic solvent is preferably added within a period from the time during the formation of the silver halide grains to the time of completing chemical ripening.

In the present invention, when a spectral sensitizing dye is dispersed in water in the form of a solid particle dispersion, a surfactant can be used. The surfactant mentioned here is either of an anionic surfactant, a cationic As a support usable for the light-sensitive material of the present invention, for example, those described in the above-mentioned RD17643, on page 28 and RD308119, on page 1009 are cited.

A suitable support includes polyethylene terephthalate. For improving adhesiveness of the coating layer, the surface of the support may be provided with a subbing layer and may also be subjected to corona discharge and UV ray irradiation.

A photographic emulsion layer of the photographic light-sensitive material of the present invention and other hydrophilic colloid layers can be coated on the above-mentioned support or other layers. As a coating method, a dipping coating method, a roller coating method, a curtain coating method, an extrusion coating method and a slide hopper method can be used. In particular, methods described in Research Disclosure (RD) Volume 176, pp. 27 to 28 "Coating Procedures" can be used.

In addition, various technologies usable in photographic technologies can be applied for embodying the present invention.

Processing of a light-sensitive material of the present invention may be conducted by use of a processing solution described in the above-mentioned RD17643, XX to XXI, pp. 29 to 30 and RD308119, XX to XXI, pp. 1011 to 1012.

As a developer used in black-and-white photographic processing, dihydroxybenzenes (for example, hydroquinone), 3-pyrazolindones (for example, 1-phenyl-3-pyrazolidone), aminophenols (for example, N-methyl-aminophenol) can be used independently or in combination of thereof. For a developing solution, conventional preservers, alkali agents, pH buffers, anti-foggants, development accelerators, surfactants, anti-foaming agents, color-regulators, hard-water softeners, dissolution aids and viscosity providing agents may be used in accordance with the necessity thereof.

In a fixing solution, a fixing agent such as thiosulfate and thiocyanate are used. In addition, as a hardener, an aqueous aluminum salts such as aluminum sulfate or potash alum may be contained therein. A preserver, a pH regulator and a water-softener may be contained.

EXAMPLES

Hereunder, examples of the present invention are explained. However, the present invention is not limited thereto.

Preparation of a Tabular Silver Bromoiodide Emulsion

A mono-dispersed cubic emulsion was prepared according to a method described in Japanese Patent O.P.I. Publication No. 61-6643/1986.

| | |
|---|---|
| Solution $A_1$ | |
| Osein gelatin | 150 g |
| Potassium bromide | 53.1 g |
| Potassium iodide | 24.0 g |
| Water was added to make 7.2 l in total. | |
| Solution $B_1$ | |
| Silver nitrate | 1500 g |
| Water was added to make 6 l in total. | |
| Solution $C_1$ | |
| Potassium bromide | 1327 g |
| 1-phenyl-5-mercaptotetrazole (methanol solution) | 0.3 g |
| Water was added to make 3 l in total. | |
| Solution $D_1$ | |
| An aqueous ammonia solution (28%) | 705 ml |

To the Solution $A_1$ stirred vigorously at 40° C., solutions $B_1$ and $C_1$ were added for 30 seconds by a double jet method to form nuclei. At this time, pBr was 1.09 to 1.15.

After 1 minute and 30 seconds, Solution $D_1$ was added to the mixture for 20 seconds and subjected to ripening for 5 minutes. During ripening, concentrations of KBr and ammonia were 0.071 and 0.63 mol/l, respectively.

After pH was regulated to 6.0, the emulsion was subjected to desalting and washing. When the resulting seed emulsion was observed with an electron microscope, it was a mono-dispersed spherical seed emulsion whose average grain size is 0.26 μm and the width of distribution is 18%.

The resulting seed emulsion was further grown by a controlled double jet method in such as manner that a silver nitrate solution and a halide solution were mixed while controlling pH and pAg. After physical ripening, the resulting emulsion was subjected to desalting so that a tabular silver bromoiodide emulsion having an average grain size of 0.60 μm, an average aspect ratio of 3.6 and an average silver iodide content of 2.0 mol % was obtained.

The emulsion was subjected to gold and sulfur sensitization by adding thereto ammonium thiocyanate, chloroaurate and sodium thiosulfate as chemical sensitizers.

Thereafter, 4-hydroxy-6-methyl-1,3,3a,7-tetrazaindene was added to the emulsion. Next, potassium iodide and the following spectral sensitizing dye (S-1), (S-2), (S-3) or (S-4) were added in an amount as shown in Table 1.

(S-1)

To 2000 g of methanol at 27° C., 14.8 g of exemplified spectral sensitizing dyes (D-11) of 14.8 g and (D-12) of 0.2 g were added and dissolved to prepare a methanol solution of the spectral sensitizing dyes.

(S-2)

To 490 g of water previously regulated to 27° C., 9.87 g of spectral sensitizing dye (D-11) and 0.13 g of spectral sensitizing dye (D-12) were added. Immediately thereafter, the mixture was stirred by means of a high speed stirrer (dissolver) illustrated in FIG. 1 at 3,500 rpm for 30 to 120 minutes to form a dispersion of the spectral sensitizing dyes.

(S-3)

To a mixture of 100 g of a 0.1% aqueous solution of isopropylnaphthalene sulfonic acid and 390 g of water, 9.87 g of spectral sensitizing dye (D-11) and 0.13 g of spectral sensitizing dye (D-12) were added. The resulting mixture was stirred with a high speed stirrer as illustrated in FIG. 1 at 3500 rpm for 30 to 120 minutes to form a dispersion of the sensitizing dyes.

(S-4)

To a mixture of 2.5 g of methanol and 487.5 g of water, 9.87 g of spectral sensitizing dye (D-11) and 0.13 g of spectral sensitizing dye (D-12) were added. The resulting mixture was stirred with a high speed stirrer as illustrated in FIG. 1 at 3500 rpm for 30 to 120 minutes to form a dispersion of the sensitizing dyes.

To the tabular silver bromoiodide emulsion, the following additives were added per mol of AgX so that emulsion coating solution Em-1 was prepared.

| | |
|---|---|
| t-butylcatechol | 400 mg |
| Polyvinyl pyrrolidone (the molecular weight is 10000) | 1.0 g |
| Trimethylolpropane | 10 g |
| Diethyleneglycol | 5 g |
| Nitrophenylphosphonium chloride | 50 g |
| Ammonium 1,3-dihydroxybenzene-4-sulfonic acid | 4 g |
| Sodium 2-mercaptobenzoimidazole-5-sulfonic acid | 15 mg |
| 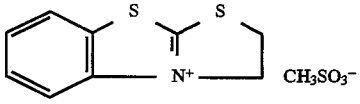 | 70 mg |
| $C_4H_9OCH_2\overset{OH}{\overset{\vert}{C}}HCH_2N(CH_2COOH)_2$ | 1 g |
| 1,1-dimethylol-1-bromo-1-nitromethane | 10 mg |
| Styrene-maleic acid anhydride copolymer | 7.5 g |
| Preparation of a cubic crystal silver bromoiodide emulsion: | |

On mono-dispersed silver bromoiodide grains having an average particle size of 0.3 μm and a silver iodide content of 2.0 mol %, silver bromoiodide containing 30 mol % of silver iodide was grown at pH 9.8 and pAg 7.8. Then, equimolar amounts of potassium bromide and silver nitrate were added at pH 8.2 and pAg 9.1 so that a mono-dispersed cubic silver bromoiodide emulsion containing an average silver iodide of 2.0 mol % was prepared.

When the emulsion obtained after desalting was observed with an electron microscope, it was revealed that a mono-dispersed cubic crystal silver bromoiodide emulsion having an average grain size of 0.40 μm, the width of dispersion of less than 16% and an aspect ratio of 1.0 was prepared.

The resulting emulsion was subjected to gold or sulfur sensitization in the same manner as in the above-mentioned tabular emulsion.

Next, 4-hydroxy-6-methyl-1,3,3a,7-tetrazaindene and potassium iodide were added.

The resulting emulsion was subjected to spectral sensitization by adding the above-mentioned spectral sensitizing dyes (S-1) and (S-2) in amounts as shown in Table 1.

To the cubic crystal silver bromoiodide emulsion, the above-mentioned additives were added per mol of AgX so that emulsion coating solution Em-2 was prepared.

Preparation of Comparative Emulsions

An emulsion Em-1 spectrally sensitized with dye (S-1) and emulsion Em-2 spectrally sensitized with dye (S-1) were mixed in a ratio of 7:3 (molar ratio) to prepare a comparative emulsion Em-3.

Similarly, an emulsion Em-1 spectrally sensitized with dye (S-2) and emulsion Em-2 spectrally sensitized with dye (S-2) were mixed in a ratio of 7:3 (molar ratio) to prepare a comparative emulsion Em-4. The above-mentioned additives were added per mol of silver halide emulsions Em-3 and 4 to prepare emulsion coating solutions.

Using these emulsions Em-1 through 4, were coated upper/lower emulsion layers, as shown in Table 1.

In addition, to a surface protective layer, the following compound was added per 1 gram of gelatin.

| | |
|---|---|
| 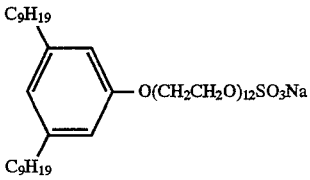 | 10 mg |
| 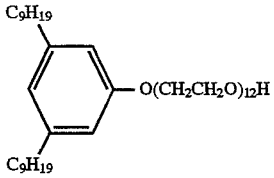 | 10 mg |
| $CH_2COOC_{10}H_{21}$<br>\|<br>$CHCOOC_5H_{11}(i)$<br>\|<br>$SO_3Na$ | 7 mg |
| $C_9F_{19}O(CH_2CH_2O)_{10}CH_2CH_2OH$ | 2 mg |
| $C_8F_{17}SO_3K$ | 3 mg |
| $C_{12}H_{25}CONH(CH_2CH_2O)_5H$ | 30 mg |
| Polymethylmethacrylate having an average particle size of 5 μm (matting agent) | 7 mg |
| Colloidal silica (an average particle size of 0.013 μm) | 70 mg |

Preparation of Light-sensitive Material

By the use of these coating solution, a test sample was prepared in the following manner.

Photographic emulsion layers was coated so as to have a gelatin amount of 2.0 g/m$^2$ silver halide grains of 1.90 g/m$^2$ in silver weight on each side.

A protective layer was coated on both sides at a speed of 80 meters/minutes by the use of a slide hopper type coater in a manner that the amount of gelatin was 1.15 g/m$^2$. The ratio of silver amount coated of each emulsion is shown in Table 1.

As a support, there was used a polyethylene terephthalate blue-colored film base for X ray diagnosis film with 175 μm thickness subbed with a copolymer composed of glycizyl methacrylate of 50 wt %, methylacrylate of 10 wt %, butylmethacrylate of 40 wt %.

Evaluation of Resolution, Sharpness and Aging Stability

Evaluation of Resolution (MTF)

By the use of a fluorescent intensifying screen KO-250 for X-ray photography use (produced by Konica), a Funk test chart SMS5852 (sold by Konica Medical Business) with 0.5 to 10 lines/mm of Samples were photographed.

By the use of an automatic processing machine SRX-501, the exposed film was processed at 35° C. for 45 seconds using a developer XD-SR and a fixer XF-SR (both are produced by Konica Corporation).

The pattern of rectangular wave recorded on a developed sample film was measured by the use of a microdensitometer PDM-5 type B (produced by Konica Corporation) wherein the measured slit size was 300 μm in parallel direction to the rectangular wave and 25 μm at the right angle direction. The resulting MTF value is represented by a spatial frequency of 2.0 line/mm.

Evaluation of Sharpness

Appendicular skeleton phantom was photographed at 30° C. of an evaluated incidence angle of X-ray and the obtained film was evaluated visually on a viewing box, based on the following five grades.

1: Very poor
2: Poor
3: Fine
4: Good
5: Excellent

Measurement of Aging Stability

Sample films were allowed to stand for 1 day, 7 days and 6 months at 23° C. and 55% RH. The aging stability of photographic performance was sensitometrically examined.

Using two fluorescent screens KO-250 (made by Konica Corp.) for radiographs, samples were subjected to exposure of X-rays for 0.05 seconds through penetrometer type B under the conditions of X-ray tube voltage of 80 kVp and X-ray tube current of 100 mA. After that, the samples were processed in the same manner as in the foregoing, and sensitivities thereof were measured. The sensitivity is represented by reciprocal of an exposure amount giving a density of fog+0.5, and it is indicated in a relative sensitivity wherein the sensitivity of Sample No. 1 stocked for one day after coating is set to be 100.

TABLE 1

| Sample No. | Emulsion layer: Upper layer | Emulsion layer: Lower layer | Upper/lower ratio | Sensitizing dye (mg/mol AgX) | Sensitivity: 1 day | Sensitivity: 7 days | Sensitivity: 6 months | MTF | Sharpness | Remarks |
|---|---|---|---|---|---|---|---|---|---|---|
| 1 | Em-3 | Em-3 | 1:1 | S-1 (370) | 100 | 88 | 64 | 0.57 | 3 | Comp. |
| 2 | Em-4 | Em-4 | 1:1 | S-2 (370) | 112 | 92 | 86 | 0.59 | 3 | Comp. |

TABLE 1-continued

| Sample No. | Emulsion layer Upper layer | Lower layer | Upper/lower ratio | Sensitizing dye (mg/mol AgX) | Sensitivity 1 day | 7 days | 6 months | MTF | Sharpness | Remarks |
|---|---|---|---|---|---|---|---|---|---|---|
| 3 | Em-2 | Em-1 | 7:3 | S-1 (370) | 96 | 84 | 61 | 0.56 | 3 | Comp. |
| 4 | Em-2 | Em-1 | 7:3 | S-2 (370) | 104 | 101 | 97 | 0.59 | 3 | Comp. |
| 5 | Em-2 | Em-1 | 3:7 | S-2 (370) | 111 | 107 | 103 | 0.61 | 4 | Comp. |
| 6 | Em-1 | Em-2 | 7:3 | S-1 (370) | 124 | 103 | 87 | 0.62 | 4 | Comp. |
| 7 | Em-1 | Em-2 | 7:3 | S-2 (370) | 136 | 133 | 131 | 0.72 | 5 | Inv. |
| 8 | Em-1 | Em-2 | 8:2 | S-2 (370) | 139 | 136 | 134 | 0.76 | 5 | Inv. |

As is apparent from Table, the silver halide photographic light-sensitive material of the present invention is excellent in sharpness and also excellent in storage stability.

What is claimed is:

1. A silver halide black and white photographic light-sensitive material comprising a support having only two silver halide emulsion layers, wherein a first layer of the silver halide emulsion layers is provided further from the support than a second layer, said first layer comprising a first silver halide emulsion containing first silver halide grains having an average aspect ratio of grain diameter to grain thickness of not less than 3, and said second layer comprising a second silver halide emulsion containing second silver halide grains having an average aspect ratio of not more than 2.5; said first and second emulsions are each spectrally sensitized by adding thereto a spectral-sensitizing dye in the form of a dispersion of solid particles dispersed in an aqueous medium.

2. The photographic material of claim 1, wherein said first silver halide grains have an average aspect ratio of 3 to 8, accounting for not less than 50% of projected areas of total grains contained in the first layer.

3. The photographic material of claim 1, wherein said first silver halide grains are twinned crystal grains.

4. The photographic material of claim 1, wherein said second silver halide grains have an average aspect ratio of 1.0 to 2.0, accounting for not less than 50% of projected area of total grains contained in the second layer.

5. The photographic material of claim 1, wherein said second silver halide grains are regular crystal grains.

6. The photographic material of claim 1, wherein said first and second silver halide grains are silver iodobromide or silver iodochloride having an average iodide content of 0.05 to 2.0 mol %.

7. The photographic material of claim 1, wherein said dye has a solubility in water of $2\times10^{-4}$ to $4\times10^{-2}$ mol per liter at 27° C.

8. The photographic material of claim 1, wherein said dye is dispersed in water substantially free from an organic solvent and a surfactant.

* * * * *